United States Patent [19]

Toker et al.

[11] Patent Number: 4,581,073

[45] Date of Patent: Apr. 8, 1986

[54] METHOD FOR DESCALING METAL STRIP

[75] Inventors: Nazmi Y. Toker, Monroeville; Donald R. Zaremski, Cheswick, both of Pa.

[73] Assignee: Allegheny Ludlum Steel Corporation, Pittsburgh, Pa.

[21] Appl. No.: 598,640

[22] Filed: Apr. 10, 1984

[51] Int. Cl.[4] ..... C03C 23/00; B08B 1/02

[52] U.S. Cl. ..... 134/2; 29/132; 134/15; 148/156

[58] Field of Search ..... 29/132; 65/374.13; 148/20, 156; 134/2, 9, 15

[56] References Cited

U.S. PATENT DOCUMENTS

| | | | |
|---|---|---|---|
| 2,984,473 | 5/1961 | Ornitz et al. | 29/132 |
| 3,080,134 | 3/1963 | England et al. | 29/132 |
| 3,502,503 | 3/1970 | Bartlo et al. | 134/2 |
| 3,544,368 | 12/1970 | Kuhn | 134/2 |
| 4,060,882 | 12/1977 | Pospisil | 29/132 |
| 4,256,519 | 3/1981 | Yoshida et al. | 178/156 |
| 4,412,503 | 11/1983 | Bakewell et al. | 29/132 |

FOREIGN PATENT DOCUMENTS

| | | | |
|---|---|---|---|
| 51-4057 | 1/1976 | Japan | 29/132 |

*Primary Examiner*—Peter Hruskoci
*Attorney, Agent, or Firm*—Patrick J. Viccaro

[57] ABSTRACT

A method is provided for descaling metal strip, such as titanium in a molten salt bath. The improvement eliminates the production of defects in the strip as a result of electrical arcing between the strip and the submersion rolls used to maintain the strip submerged within the molten salt bath. The method includes providing a portion of the roll with an electrically insulating coating so that the arcing between the strip and the roll is eliminated.

A roll having a coating thereon and useful in molten salt bath descaling processes is also provided.

8 Claims, 1 Drawing Figure

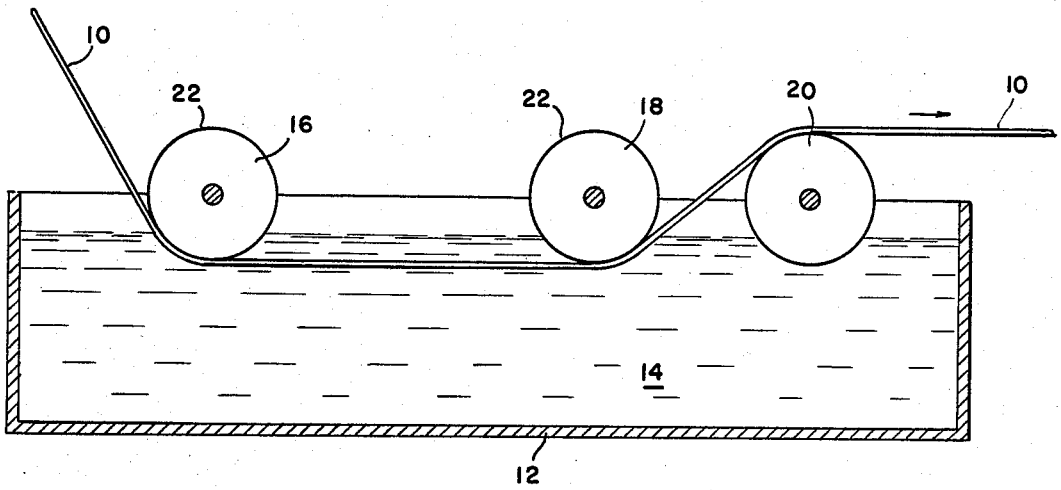
10
22
16
22
18
20
10
14
12

METHOD FOR DESCALING METAL STRIP

BACKGROUND OF THE INVENTION

This invention relates to a method and apparatus for descaling metal strip by pickling. More particularly, this invention relates to a method and apparatus for eliminating the galvanic potential between the metal strip and rolls in the descaling media to improve metal strip surface quality.

In the production of metal alloy strip, the material is subjected to a hot-rolling operation which produces scale on the strip surface. Prior to subsequent cold rolling to final gauge, this scale produced during hot rolling must be removed, otherwise, the scale will be rolled into the strip surface to render the surface quality of the cold-rolled strip unacceptable for the desired final product applications.

It is known to remove this scale after hot rolling by continuously passing the strip through a tank containing a caustic descaling media, such as a molten salt bath. The strip is maintained submerged within the molten salt bath by the use of metal rolls which are likewise at least partially submerged within the molten salt bath.

In molten salt descaling operations of this conventional type, electrical arcing results between the strip and the roll due to the electrical potential difference which exists between the metal strip and the common iron or steel roll. The galvanic potential results in an electrical discharge or arc between the metal strip and roll. The potential difference between the metal strip and rolls is the open cell potential which is discharged through the metal strip and roll contact in the form of electrical arcing. Though potential differences may result for metal strip of steel and stainless steel compositions, it is particularly acute for a class of metal alloys, such as titanium, titanium base alloys, zirconium and zirconium base alloys, which exhibit more dissimilarity from the steel rolls. This arcing results in the production of surface defects on the metal strip after descaling, and these defects render the product less acceptable for its intended final product applications. The defects resulting from the electrical arcing are in the form of pitting of the surface, commonly referred to as electrolytic or galvanic pits.

It is known in the art to reduce or eliminate the galvanic potential between the strip and the roll by the use of a countercurrent electromotive force (EMF) as disclosed in U.S. Pat. No. 2,826,539, issued Mar. 11, 1958. Generally, the countercurrent EMF is useful to reduce electrolytic pitting; however the method requires special techniques and an additional electrical system to produce the EMF. It is also known that the galvanic potential may be reduced by using caustic molten salt bath compositions which permit lower operating bath temperatures. Such caustic baths generally are more expensive and add to overall production costs.

It is, accordingly a primary object of the present invention to provide an improvement in molten salt descaling of metal strip product, particularly titanium and titanium base alloys, wherein surface defects resulting from electrical arcing between the strip and the rolls used to maintain the strip within the molten salt bath are eliminated.

This and other objects of the invention as well as a more complete understanding thereof may be obtained from the following description and specific examples.

SUMMARY OF THE INVENTION

In accordance with the present invention, a method is provided for descaling metal strip in a molten salt bath including passing the strip through the bath for scale removal by means of a submersion metal roll which maintains the strip within the bath during descaling. The roll is coated on portions which contact the strip with an electrically insulating coating to eliminate electrical arcing between the strip and the roll.

A roll having a coating and useful in molten salt bath descaling processes is also provided.

BRIEF DESCRIPTION OF THE DRAWING

The FIGURE is an elevation view of a descaling tank useful for the present invention.

DETAILED DESCRIPTION OF THE PREFERRED EMBODIMENTS

The FIGURE illustrates metal strip 10 passing through and submerged in a descaling or pickling tank 12 containing a caustic descaling bath 14. Within the tank 12 are rolls 16 and 18, which are immersion or submersion rolls, for maintaining the metal strip 10 in the bath 14. Also shown is a wiper roll 20 over which the metal strip 10 passes as it leaves tank 12.

Broadly, the improvement of the invention is providing a coating 22 on one or more of the rolls 16, 18 and 20 of an electrically insulating material of a thickness sufficient to provide electrical insulation between the strip and the metal of the roll body over or on which the strip passes during its travel through the molten salt bath. The dielectric coating 22 may be any of various materials suitable for the purpose of providing adequate electrical insulation, high temperature resistance and corrosion resistance to molten salt attack. The coating should be temperature resistant up to 1000° F. (537° C.). Suitable ceramic coatings are $ZrO_2$, $Al_2O_3$, MgO, $MgZrO_3$ and combinations thereof. A coating thickness of about 5 to 30 mils, and preferably about 15 mils, may be used. Conventional methods for applying the coating may be used, although high temperature plasma spraying is preferred for ceramic coatings.

The practice of the invention includes coating of the roll body 16, 18 and 20 with the ceramic material coating 22, which roll body comes in contact with the strip during descaling. The rolls are conventionally made of steel. The caustic descaling bath may be a molten salt bath. Such molten salts conventionally used are mixtures of hydroxides and nitrates and typically sodium hydroxide and sodium nitrate, as well as other such salts of the alkali metals. After descaling in molten salts, the strip is subjected to a cleaning operation to remove the residual salt and any scale adhering to the strip surface.

As a specific example to demonstrate the effectiveness of the improvement of the invention, the following trials were performed by way of demonstration.

EXAMPLE 1

Seven coils of titanium strip were descaled in a substantially conventional manner, except that the coated rolls of the present invention were used. The steel submersion rolls in the descaling or pickling tank had been coated with 15 mils of magnesia zirconate ($MgZrO_3$) by the plasma spraying technique. The molten salt bath comprised a mixture of primarily sodium hydroxide and sodium nitrate at about 900° F. (482° C.). All seven coils were successfully descaled in that no electrical arcing was observed throughout the descaling process and no galvanic pits, i.e., arc-related defects, were observed on the strip surface.

EXAMPLE 2

Three coils of titanium strip subsequently were descaled in the same manner and using the same coated submersion rolls of Example 1. All three coils were successfully descaled and no arcing was observed during the process and no arc-related defects were observed on the strip surface.

As was an object of the present invention, the method and apparatus eliminate the arcing potential between the metal strip and rolls in descaling processes. An advantage, however, is that the coated rolls have been found to compare in durability with uncoated rolls of the prior art. A further advantage is that the same rolls have been shown useful in descaling titanium and then stainless steel without adversely affecting the surface quality of the stainless steel. Still further, the same coated rolls have been used to successfully descale wide and narrow strip including successive runs of wide, then narrow and then wide strip without developing a wear pattern. In the roll surface of uncoated rolls, a worn roll pattern typically develops as a result of varying strip widths.

While several embodiments of the invention have been shown and described, it will be apparent to those skilled in the art that modifications may be made therein without departing from the scope of the present invention.

What is claimed is:

1. A method for descaling metal strip selected from the group consisting of steel, stainless steel titanium, titanium base alloys, zirconium, and zirconium base alloys in a molten salt bath comprising passing the strip through a molten salt bath for scale removal by means of a submersion iron or steel roll which maintains the strip within the bath during descaling and providing the portion of said roll in contact with said strip with an electrically insulating coating having a thickness sufficient to reduce electrical arcing between the strip and the roll to eliminate surface defects on said strip.

2. The method of claim 1 wherein the coating is a ceramic material.

3. The method of claim 2 wherein said ceramic material is selected from the group consisting of $ZrO_2$, $Al_2O_3$, MgO, $MgZrO_3$ and combinations thereof.

4. The method of claim 2 wherein the thickness of said coating is within the range of about 5 to 30 mils.

5. The method of claim 1 wherein said coating is $MgZrO_3$.

6. In a method for descaling titanium strip in a molten salt bath including passing the strip through a bath of molten salts of alkali metals for scale removal by means of a submerged iron or steel roll which maintains the strip product within the bath during descaling, the improvement comprising coating the portion of said roll in contact with said strip product with a ceramic coating having a thickness within the range of about 5 to 30 mils to reduce electrical arcing between the strip and the roll so as to eliminate electrolytic pitting of the strip caused thereby.

7. The method of claim 6 wherein the ceramic coating is selected from the group consisting of $ZrO_2$, $Al_2O_3$, MgO, $MgZrO_3$ and combinations thereof.

8. The method of claim 6 wherein the coating is $MgZrO_3$.

* * * * *